US010835787B1

(12) United States Patent
Evans et al.

(10) Patent No.: US 10,835,787 B1
(45) Date of Patent: Nov. 17, 2020

(54) GOLF CLUB WITH PERIMETER FACE MACHINING

(71) Applicant: Cobra Golf Incorporated, Carlsbad, CA (US)

(72) Inventors: D. Clayton Evans, San Marcos, CA (US); Cameron J. Day, Vista, CA (US); Michael T. McDonnell, Carlsbad, CA (US); Ryan L. Roach, Carlsbad, CA (US); Douglas E. Roberts, Carlsbad, CA (US); Bryce Hobbs, Carlsbad, CA (US); Yi-ching Liao, Carlsbad, CA (US)

(73) Assignee: COBRA GOLF CORPORATION, Carlsbad, CA (US)

( * ) Notice: Subject to any disclaimer, the term of this patent is extended or adjusted under 35 U.S.C. 154(b) by 0 days.

(21) Appl. No.: 16/530,514

(22) Filed: Aug. 2, 2019

Related U.S. Application Data

(60) Provisional application No. 62/767,790, filed on Nov. 15, 2018.

(51) Int. Cl.
*A63B 53/04* (2015.01)

(52) U.S. Cl.
CPC ..... *A63B 53/0466* (2013.01); *A63B 53/0437* (2020.08); *A63B 53/0445* (2020.08)

(58) Field of Classification Search
CPC ..... A63B 2053/0445; A63B 53/0466; A63B 2053/0437
See application file for complete search history.

(56) References Cited

U.S. PATENT DOCUMENTS

| | | | | |
|---|---|---|---|---|
| 4,065,133 | A * | 12/1977 | Gordos | A63B 53/04 473/327 |
| 4,754,974 | A * | 7/1988 | Kobayashi | A63B 53/04 473/327 |
| 5,190,289 | A * | 3/1993 | Nagai | A63B 53/00 473/327 |
| 8,827,832 | B2 * | 9/2014 | Breier | A63B 53/047 473/331 |
| 8,845,453 | B1 * | 9/2014 | Ehlers | A63B 60/00 473/327 |
| 8,864,601 | B1 * | 10/2014 | Ehlers | A63B 60/00 473/327 |
| 9,162,117 | B2 * | 10/2015 | Ehlers | A63B 53/0466 |
| 9,486,676 | B1 * | 11/2016 | Thall | A63B 53/04 |
| 10,343,034 | B2 * | 7/2019 | Henrikson | A63B 53/0466 |
| 10,596,423 | B2 * | 3/2020 | Henrikson | A63B 53/0466 |
| 2008/0132352 | A1 * | 6/2008 | Ban | A63B 53/047 473/331 |

(Continued)

FOREIGN PATENT DOCUMENTS

| | | | | |
|---|---|---|---|---|
| JP | 08173579 | A * | 7/1996 | A63B 53/0466 |

*Primary Examiner* — Stephen L Blau
(74) *Attorney, Agent, or Firm* — Quarles & Brady LLP

(57) ABSTRACT

The invention provides golf clubs and methods of making golf clubs with machined perimeter faces. The club faces provide an accurate ball striking surface and improved aerodynamics. In particular, a surface is milled into the club face that expands over an edge of a ball striking surface and onto a portion of the face adjacent to at least one of a crown, a sole, a toe, or a heel. During a swing, the milled surface causes the boundary layer of airflow to separate at a point closer to the rear of the club head, resulting in reduced drag.

20 Claims, 9 Drawing Sheets

(56) References Cited

U.S. PATENT DOCUMENTS

| | | | | |
|---|---|---|---|---|
| 2009/0318245 | A1* | 12/2009 | Yim | A63B 53/0466 473/342 |
| 2013/0331197 | A1* | 12/2013 | Hackenberg | A63B 60/02 473/251 |
| 2017/0065859 | A1* | 3/2017 | Henrikson | A63B 60/52 |

* cited by examiner

GOLF CLUB WITH PERIMETER FACE MACHINING

CROSS-REFERENCE TO RELATED APPLICATIONS

This application claims the benefit of and priority to U.S. Provisional Application Ser. No. 62/767,790, filed Nov. 15, 2018, the content of which is incorporated by reference herein in its entirety.

FIELD OF THE INVENTION

The disclosure relates to golf clubs and methods of manufacturing golf clubs.

BACKGROUND

When a golfer strikes a golf ball, the golfer generally wants the ball to travel a certain distance in a direction towards a hole. Unfortunately, the golf ball does not always go as far as desired or in the intended direction. This can cause the golfer to feel frustrated.

In an effort to help the golfer hit the ball, some golf clubs are made with larger club heads. This is helpful because a large club head has more surface area on the face and has a rotational moment of inertia that resists twisting during the golfer's swing. This helps the golfer make consistent contact with the ball and keep the club head straight at impact so that the golf ball is more likely to travel in a straight line.

Unfortunately, large club heads have disadvantages too. Large club heads have larger flat surfaces on their leading side that resists moving through the air. The air resistance reduces club head speed and since club head speed is directly related to distance that the ball will travel upon impact, a ball hit with a larger club head will go a shorter distance. Therefore, while a large club head can improve the golfer's ability to strike the ball in the intended direction, it will also subtract from the distance.

SUMMARY

The invention relates to golf clubs and methods of making golf clubs with machined perimeter faces. The machined faces are made according to exacting standards that provide an accurate hitting surface with improved aerodynamic efficiency. In particular, the faces include a machined surface that expands over an edge of a striking surface and into a portion of the face adjacent to at least one of a crown, a sole, a toe, or a heel. Perimeter face machining gives a smooth border that reduces drag and increases club head speed.

The machined surface includes a pattern that expands across the face. The pattern may include an arrangement of grooves that improve aerodynamics. Grooves can improve club head aerodynamics by interrupting air flow as the club is swung through the air. Specifically, during the swing, the grooves can disrupt laminar flow of the layer of air that travels away from the center point of the club face. As that layer flows past the face and over the crown and the sole, the layer will separate from the crown and sole at a point closer to the rear of the club head, thereby improving the club head aerodynamics by reducing drag. This allows the club head to move with greater speed during the swing.

Perimeter face machining improves aerodynamics so that more of the golfer's swing force serves to accelerate the club head. This allows the club head to travel at a greater speed and therefore, to strike a ball with greater force. Consequently, golf clubs with perimeter face machining allow the golfer to hit the golf ball a farther distance.

In some aspects, the disclosure provides golf clubs with a machined surface that is expanded around an entire perimeter of the ball striking surface. This provides a smooth border around a circumference of the club face to improve aerodynamics. For example, during a golfer's downswing, the club head exerts pressure on the air immediately in front of the club face. The smooth border formed by perimeter face machining can be beneficial because it facilitates the passage of turbulent airflow around the club head.

The innovation to expand club face machining over a perimeter of a ball striking surface provides game improvement features that help reduce drag and improve aerodynamics. Because of these features, more of the golfer's swing force is used to accelerate the club head during the swing. And therefore, the club head travels at a faster speed and, upon impacting a golf ball, the golfer is rewarded with increased ball trajectory. For at least these reasons the extended machined surface over the perimeter of the ball striking surface provides an advantage to existing club head designs.

In some aspects, the invention provides a golf club head comprising a body including a crown, a sole, a toe, a heel, and a club face with a ball striking surface. The crown and sole extend back from a front portion when the club head is at address and join at a rear portion of the club head body. A hosel extends upwards from the heel side of the club head. The club face includes a machined surface that traverses a perimeter of the ball striking surface and onto a portion of the face where the face meets at least one of the crown, the sole, the toe, or the heel.

The club head is preferably a hollow, wood-type club head, such as for a driver or hybrid club. The face of the club head may have a bulge radius, or a roll radius, or both, to provide a more precise horizontal face curvature that delivers better accuracy on shots hit on the heel or toe of the club face. These features provide a more forgiving striking surface so that mishits travel in a more desirable direction.

The machined face includes a pattern cut into the surface. The pattern can include any arrangement of aerodynamic features. The pattern may include grooves in an arrangement designed to trip air flow. In particular, the pattern may include a plurality of grooves arranged such that they radiate outward from a central portion of the ball striking surface. The spacing between any pair of adjacent grooves preferably increases at increasing radial distances from the central portion of the ball striking surface. The plurality of grooves may traverse a perimeter of the ball striking surface and onto a portion of the face where the face meets at least one of a crown, a sole, a toe, or a heel. Preferably the plurality of grooves traverse an entire perimeter of the ball striking surface and expands onto the face where the face meets each one of the crown, the sole, the toe, and the heel.

The central portion may comprise a single groove. The single groove can be substantially circular and in some instances form a spiral. The spiral may include a plurality of parallel curves with a separation distance between any two adjacent parallel curves that is approximately equal. The spiral can indicate a preferred impact area, or sweet spot, on a ball striking surface. This aids the golfer in identifying the optimal area of the striking surface with which to strike the ball. In addition, the spiraled groove provides an enhanced impact area that can absorb shock energy upon impact with a golf ball. This reduces the probability that the club face will crack when striking a ball. In addition to improving aerodynamics, the machined club face can provide a texture that improves ball control.

In other aspects, the invention relates to methods for making golf clubs with machined perimeter faces. The method includes the use of machining tools, such as, for example, computer numerical control (CNC) milling to provide greater precision in making structural features on the club faces.

A club head including a club face may be made from a single piece of material. Or, the club face can be formed from a separate piece of material that can be attached to a separately constructed club head. For example, a method of making a club head consistent with the present disclosure includes providing a face of a club head, the face include a ball striking surface and a perimeter defining a border of the ball striking surface. The face can be made from a material suitable for milling and subsequent use in striking balls, such as, titanium, steel, aluminum, carbon fiber, or scandium. In some embodiments, the face is convex and suitable for the head of a hollow type club, such as a driver or fairway wood. The method further includes providing a golf club head body configured to receive the face, wherein the club head body may generally include a crown, a sole, a toe, a heel, and/or a hosel. It should be noted that one or more portions of the club head body may be constructed from a metal material and other portions may be constructed from a composite material. For example, in some embodiments, the club head body may be formed by casting methods (i.e., casting a metal to form at least a portion of a club head body). It should be noted that one or more portions of the club head body may include composite materials that can be coupled to a casted portion (i.e., composite crown, sole, heel, toe, etc.).

The method further includes attaching the face to a front portion of the club head body. For example, the face may be attached to the front portion of the club head body by welding the face onto the club head body. However, one skilled in the art should recognize that any suitable method can be used to attach the face to the body, for example, welding, swaging, a tongue-and-groove attachment, a dovetail attachment, mechanical fasteners such as screws, adhesives, press-fit, bendable feet, or any other suitable attachment method. After the club face is attached to the club head body, the club face can be milled to cut a machined surface into the ball striking surface that traverses at least a length of the perimeter of the ball striking surface A milling machine can be used to machine the club face. The milling machine can be a computer numerical control (CNC) milling machine, which can construct a milled surface having a precise arrangement of shapes and dimensions for disrupting airflow and improving other aspects of the ball striking face such as ball control. The club face is machined to cut a surface into the face and expands over a perimeter defining a border separating a ball striking surface and a remaining portion of the face. The machined surface includes a pattern that improves aerodynamics.

In other aspects, the methods generally include the steps of providing a golf club head comprising a body, a crown, a sole, a toe, a heel, and a face with a ball striking surface and using a milling machine to cut a milled surface into the face such that the milled surface expands over a perimeter of the ball striking surface and into a portion of the face that meets at least one of the crown, the sole, the toe, the heel. Preferably, the machined surface traverses the entire perimeter of the ball striking surface to join each of the crown, the sole, the toe, and the heel.

Methods of the invention include machining a pattern onto a club face. The pattern expands over a radial edge of a ball striking surface. The pattern may include a plurality of grooves radiating outward from a central portion of the ball striking surface. The spacing between any pair of adjacent grooves may increase at increasing radial distances from the central portion of the ball striking surface and also extend over a perimeter of the ball striking surface. The central circular portion can comprise a grooved spiral, wherein the spiral comprises a plurality of parallel curves and a separation distance between any two adjacent parallel curves is approximately equal. The pattern milled onto the surface can be designed into order to maximize the disruption of laminar air flow away from the club face to improve aerodynamics of the club head. The pattern can also be designed in order to maximize ball control. For example, the pattern may provide a texture that enhances friction between the club head for increased control.

DETAILED DESCRIPTION

Provided herein are golf club heads and methods of making golf club heads with machined faces. The club heads include machined surfaces on a perimeter of the face to improve aerodynamic efficiency. Club heads have machined perimeter faces according to exacting standards that provide an optimal hitting surface and improved aerodynamic features, such as reduced drag. The machined surface includes a pattern cut into a ball striking surface that expands over an edge of a radius around at least one of a leading edge, a toe, or a topline. Perimeter face machining creates an accurate hitting surface while also creating a consistent and smooth border that serves as an aero trip.

During the swing, a club head generally experiences two types airflow across the club head, laminar and turbulent. Laminar flow is consistent airflow across the surface that leaves a smooth wake. Turbulent flow leaves a rough, disturbed wake. While turbulence is bad for an airplane wing, it is desirable for golf club head because it is associated with less drag.

When a conventional club head moves through the air, the airflow over the surface of the face forms a boundary layer that exhibits laminar flow. The air moves away from a stagnation point on the club face and toward an edge where the face meets the crown or the sole. As the boundary layer passes from the face to the crown and sole, it separates from the club head. For a club with a smooth face, the separation of the boundary layer occurs at a short distance from the face and at a short time interval during its travel across the club head. This early separation of the boundary layer produces high aerodynamic drag. As a result, much of the force of the golfer's swing is directed toward combating drag, and the velocity of the club head is reduced. Since club head velocity is directly related to distance that ball will travel, reduced club head velocity means the golfer will hit the ball a shorter distance.

Conversely, when a club head according to aspects of the invention moves through the air, the perimeter machined face helps to trip airflow across the face and cause airflow to transition from laminar flow to turbulent flow. Turbulent flow resists flow separation better than laminar flow does, so separation of the boundary layer occurs at a greater distance from the face along the front-rear axis of the club head and at a longer time interval during its travel across the club head. This delayed separation of the boundary layer leads to reduced aerodynamic drag. Consequently, less of the force of the golfer's swing is used to counteract drag, resulting in a higher velocity of the club head and increased ball trajectory upon impact.

Figure 1:
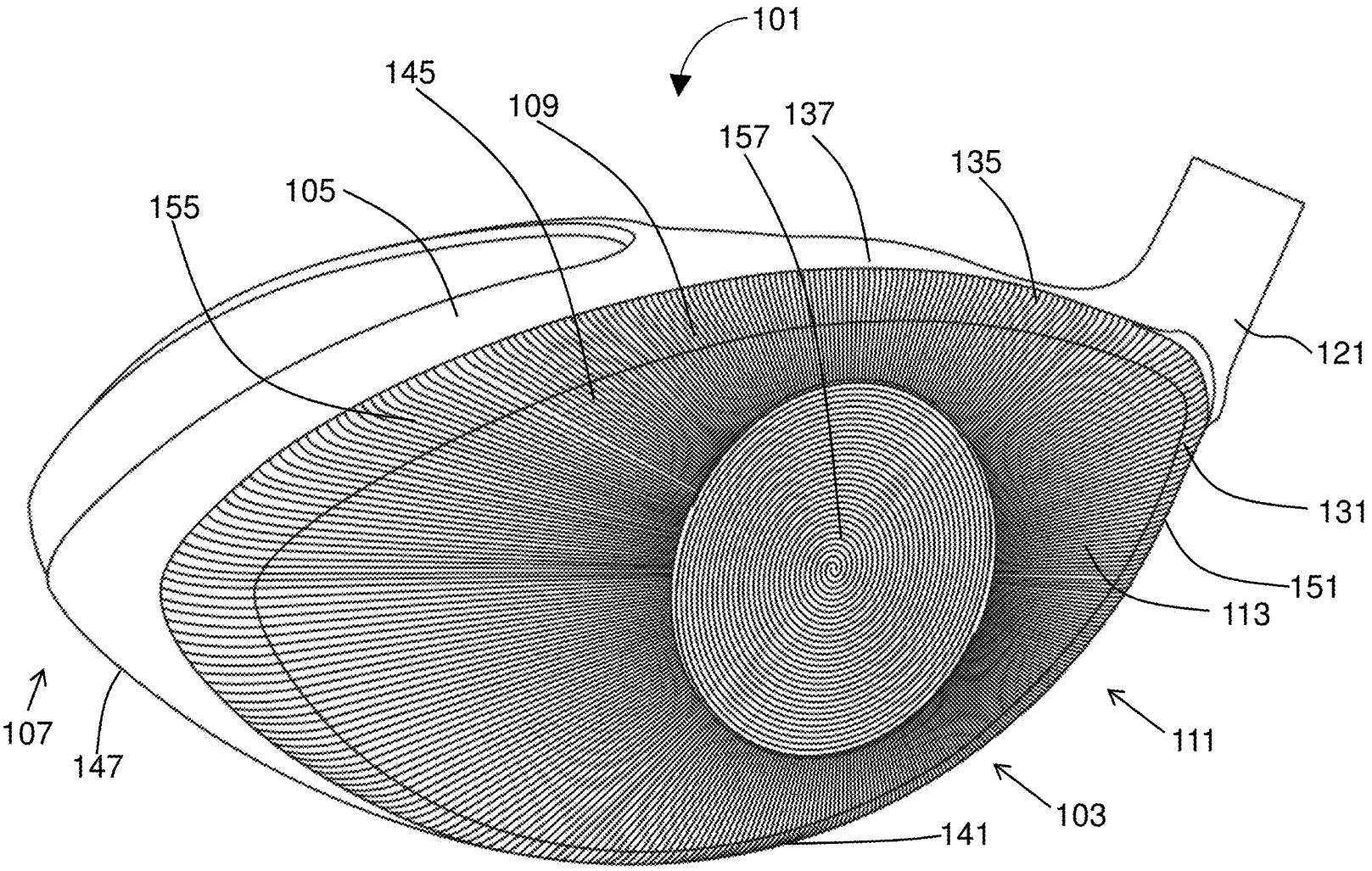
FIG. 1 shows a golf club head with perimeter face machining.

FIG. 1 shows a golf club head 101 according to aspects of the invention. The club head 101 has a body 105 defined by a crown 137 and a sole 141 that extends back from a front portion 103 comprising a face 109 to meet on at a rear side of the body 105. The face 109 includes a ball striking surface 113 with a perimeter 131 that defines a border separating the striking surface 113 from a portion of the face 109 that is adjacent to the crown 137, the sole 141, a toe 147 and a heel 151. The club head 101 also includes a hosel 121 extending up from a heel-side 111 of the body 105 for attachment to a shaft.

Club head 101 is depicted as a driver, but may be any style of club head including, for example, a putter, wedge, iron, hybrid, or wood-type club head. In a preferred embodiment, club head 101 is a hollow, wood-type club head (i.e., a driver, fairway, or hollow hybrid), most preferably a driver.

The club head 101 includes a face 109 manufactured by methods of the invention. The face may be monolithically formed with club head body 105 or may be a separate piece attached to the body 105. Any suitable method can be used to attach the face 109 to the body 105. For example, a club head 101 can be monolithically formed, and the disclosed milling process of the present invention can be performed on the front face 109 of the club head. Alternatively, a separate face insert 109 piece may be attached to the club head 101 by, for example, welding, swaging, a tongue-and-groove attachment, a dovetail attachment, mechanical fasteners such as screws, adhesives, press-fit, bendable feet, or any other suitable attachment method. Exemplary methods of attaching a face insert to a club head are discussed in U.S. Pat. Nos. 8,491,412; 8,485,918; 8,480,512; 8,172,698; 7,811,179; 7,811,180; 7,588,503; U.S. Pub. 2004/0157677; and U.S. Pub. 2003/0153397, the contents of each of which are incorporated by reference for all purposes.

The club head 101 has a machined face 109 that can be formed by etching the surface or by a machining tool, such as a milling machine. Milling is a process that uses rotary cutters to cut material away from a workpiece as it is fed along an axis of the milling machine. In general, milling works on the principle of rotary motion. A milling cutter is spun about an axis while a workpiece is moved through it in such a way that the blades of the cutter are able to cut away material from the workpiece with each pass. Milling processes make many individual cuts on the material in a single run using a cutter with many teeth.

Preferably, computer numerical control (CNC) milling is used to machine the club face 109. CNC milling can create a milled face 109 having a precise arrangement of shapes and dimensions. The CNC machine may include multiple tools, such as drills and saws, to mill the face. Computer-aided design (CAD) software may be used to define the dimensions of the milled surface, which can then be translated into manufacturing directives by computer-aided manufacturing (CAM) software.

Methods and tools for using CAD and CAM software to perform CNC milling on curved surfaces are discussed in Pan, Y. et al., Multitool and Multi-Axis Computer Numerically Controlled Accumulation for Fabricating Conformal Features on Curved Surfaces, Journal of Manufacturing Science and Engineering, 136:031007 (June 2014); and US Publication No. 2013/0297064, which is incorporated by reference.

FIG. 1 shows a club face 109 with a machined surface 145 that expands over a perimeter 131 of a ball striking surface 113 and into a portion of the face 109 adjacent to each of the crown 137, the sole 141, the toe 147, and the heel 151. The machined surface 145 includes a pattern of aerodynamic features that facilitate tripping of air flow. The pattern can comprise any arrangement of aerodynamic features that facilitates tripping. The clubface 109 shown in FIG. 1 presents a machined surface 145 with a pattern having a plurality of grooves 155 expanding from a central portion 157 of the striking surface 113, and traversing the perimeter 131 of the striking surface 113. The plurality of grooves 155 may extend from the central portion 157 in a generally straight line across the convex face 109. When viewed from an axis orthogonal to the face 109, the plurality of grooves 155 may have the shape of arcs and may be arranged concentrically around the central portion 157. Alternatively, when viewed from an axis orthogonal to the face, the plurality of grooves 155 may appear linear. Individual grooves of the plurality of grooves 155 are separated by a distance. The distance may increase at increasing radial distances from the central portion 157. Preferably the distance between any two individual grooves of the plurality of grooves 155 is no more than 0.5 inches.

The plurality of grooves 155 may extend rearward from the central portion 157 across an entire distance of the face 109. In some instances, a portion of the plurality of grooves 155 extends a distance that is farther across the face than another portion of the plurality of grooves 155.

In some aspects, perimeter face machining can create a smooth border around a circumference of the club face to improve aerodynamics. When the club head 101 is swung, the club head 101 exerts pressure on the air in front of the ball striking surface 113. The smooth border created by perimeter face machining can facilitate the movement of that air around the club head 101 to reduce pressure and increase swing speed. The perimeter face machining provides a more favorable angle for air flow with a smoother transition surface between the ball striking surface 113 and the rest of the club head body 105, which can reduce air resistance. Additionally, the border may include a ramped surface where the machined surface meets at least one of a crown 137, a sole 141, a toe 147 or a heel 151. The ramped surface can accelerate air flow rearwardly away from the back of the club head. The ramped surface can also create turbulent airflow to reduce drag.

The machined face can include aerodynamic features characterized by a pattern of any one of grooves, dimples, depressions, protrusions, or any combination thereof. The pattern may create a textured surface having favorable aerodynamic properties or improve ball control. For example, the pattern may be strategically designed to disrupt the air flowing across the club face to create turbulent airflow and reduce drag. The pattern may also create a club face having enhanced ball control. For example, the pattern may create a textured surface that allows a golfer to put more friction on the ball during play. A golfer can use friction to put more spin and thus have more control over the ball.

Figure 2:
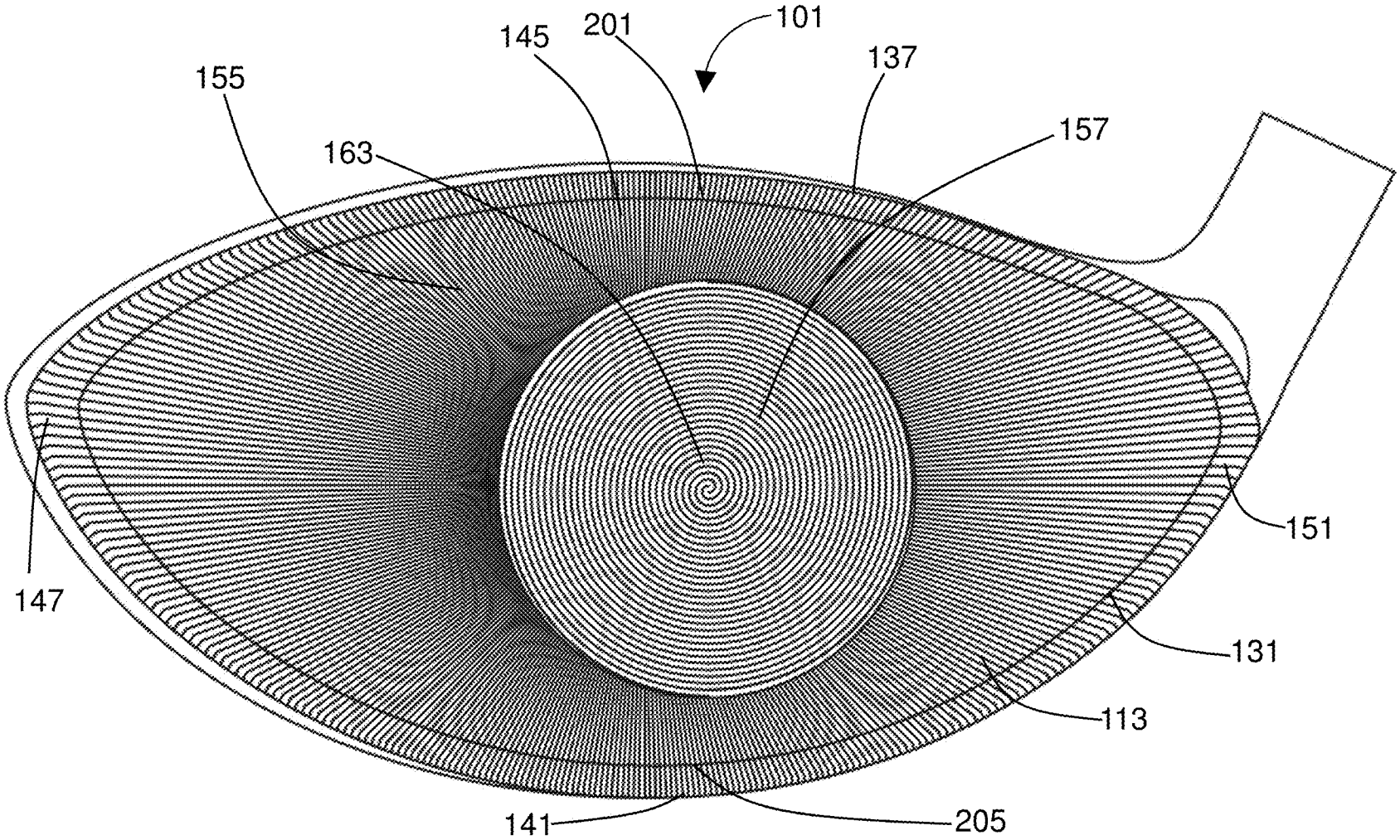
FIG. 2 shows a front view of a club head.

FIG. 2 shows a front view of the club head 101 according to aspects of the invention. The club head 101 has a machined surface 145 on a club face 109. The machined surface 145 expands over a ball striking surface 113 and traverses a perimeter 131 into a portion of the club face 109 that joins each of a crown 137, a sole 141, a toe 147, and a heel 151. The machined surface 145 includes a pattern of aerodynamic features. Preferably, the pattern comprises a plurality of grooves 155 that extends rearward from a central portion 157 of the ball striking surface 113 and onto the portion of the face 109 that meets the crown 137, the sole 141, the toe 147, and the heel 151.

In some aspects, the club head 105 includes a plurality of grooves 155 radiating from a central portion 157 of the ball striking surface 113. The plurality of grooves 155 may be defined by indentations cut into the surface of the ball striking surface 113 relative to adjacent portions of the face. Preferably, the plurality of grooves 155 is substantially straight along their length and across the convex face 109. When viewed from an axis orthogonal to the face 109, the plurality of grooves may appear arc shaped. In some instances it might be desirable to provide a club face 109 with a pattern comprising a plurality of wavy or ripple-shaped grooves. Depending on the shape of the plurality of grooves 155, the club face can have different airflow velocity profiles and impart different ball striking characteristics.

The central portion 157 may comprise a single groove. The single groove may be substantially circular and in some instances form a spiral 163. As illustrated in FIG. 2, the spiral 163 may expand outwardly to an outer boundary that is arranged inwardly from the perimeter 131. The outer boundary may define an interface between the spiral 163 and the plurality of grooves 155. For example, the plurality of grooves 155 may extend outwardly from the outer boundary of the spiral 163. The spiral 163 can have a plurality of parallel curves and a separation distance between any two adjacent parallel curves that is approximately equal. Preferably the separation distance between any two adjacent parallel curves is no more than 0.25 inches. The spiral 163 can indicate a preferred impact area, or sweet spot, of the club face. This aids the golfer in identifying the optimal area of the club face with which to strike the ball. In addition, the spiraled groove can provide an improved impact area that can better absorb shock energy upon impact with a golf ball. This reduces the probability that the club face will crack upon impact.

The central portion 157 may extend from a top edge 201 to a bottom edge 205 of a perimeter 131 of a ball striking surface 113. In other aspects, the central portion 157 can be positioned a distance of 0.1 inches to 1.5 inches away from either one of the top edge 201 or the bottom edge 205. The distance between the central portion 157 and the top edge 201 can be equal to the distance between the circular portion 157 and the bottom edge 205, or the distances can be different. Alternatively, the central portion 157 can extend over the top edge 201 or the bottom edge 205, or both.

Figure 3:
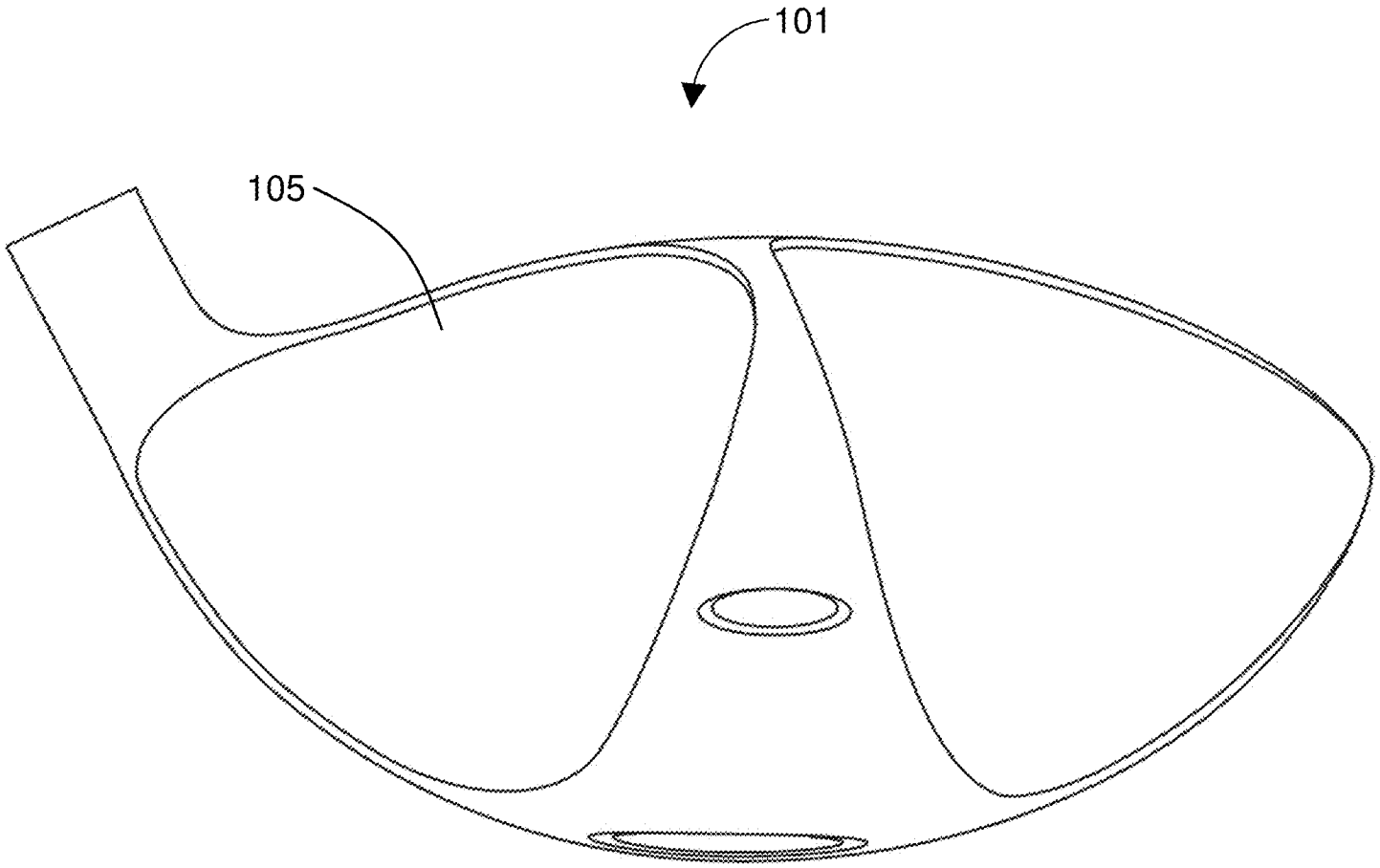
FIG. 3 shows a rear view of a club head.

FIG. 3 shows a rear view of a club head 101. From a rear view, aspects of perimeter face machining might not be visible. This may indicate the circumference of a rear portion of the club head body 105, when at address, is larger than the circumference of the front portion that includes the machined face.

Figure 4:
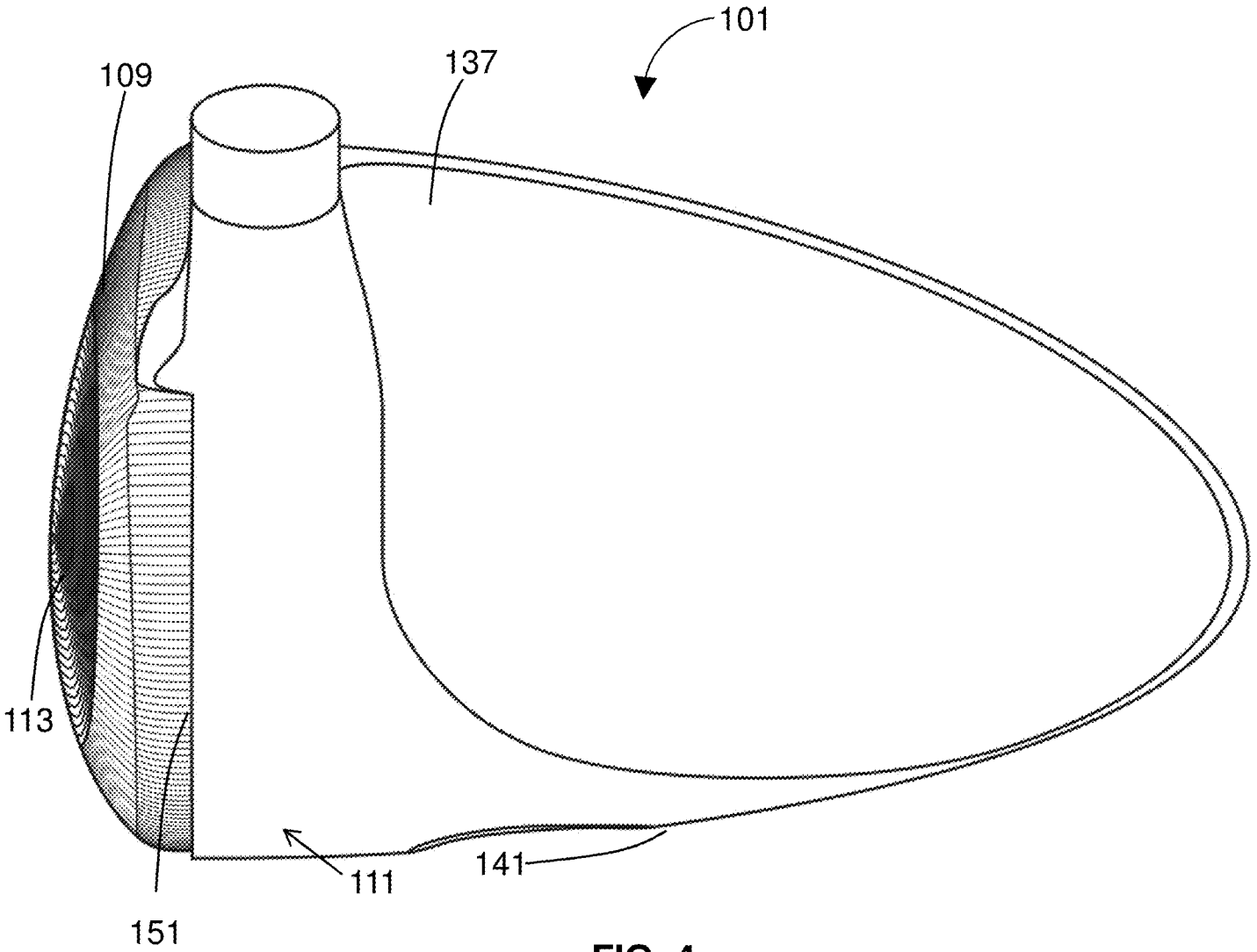
FIG. 4 shows a golf club head from a heel-side view.

FIG. 4 shows a golf club head from a heel-side 111. The club head 101 includes a machined face 109 comprising a ball striking surface 113. Preferably the face 109 is a curved convex face.

As described in detail in US 2013/0029780, which is incorporated by reference, a convex face has a roll measured along a vertical axis and a bulge measured along a horizontal axis. The vertical roll of the club head measured from a side view can be defined as the value of a radius, R, at any given point along a club face. This provides a measure curvature. For example, R can be measured on a number of horizontal axes to provide a measure of curvature along a vertical direction from a crown to sole of club head about each of the horizontal axes.

According to the disclosure, the golf club head 101 includes a machined surface that extends over an edge of a ball striking surface 113 and onto a portion of the face 109 where the face 109 meets any one of a crown 137, a sole 141, a toe 147, or a heel 151. In some aspects, the machined surface may extend farther into any one of the crown 137, the sole 141, the toe 147, the heel 151, or any combination thereof. The machined surface may extend either a substantial or insubstantial distance across any one of the crown 137, the sole 141, the toe 147, and the heel 151.

Figure 5:
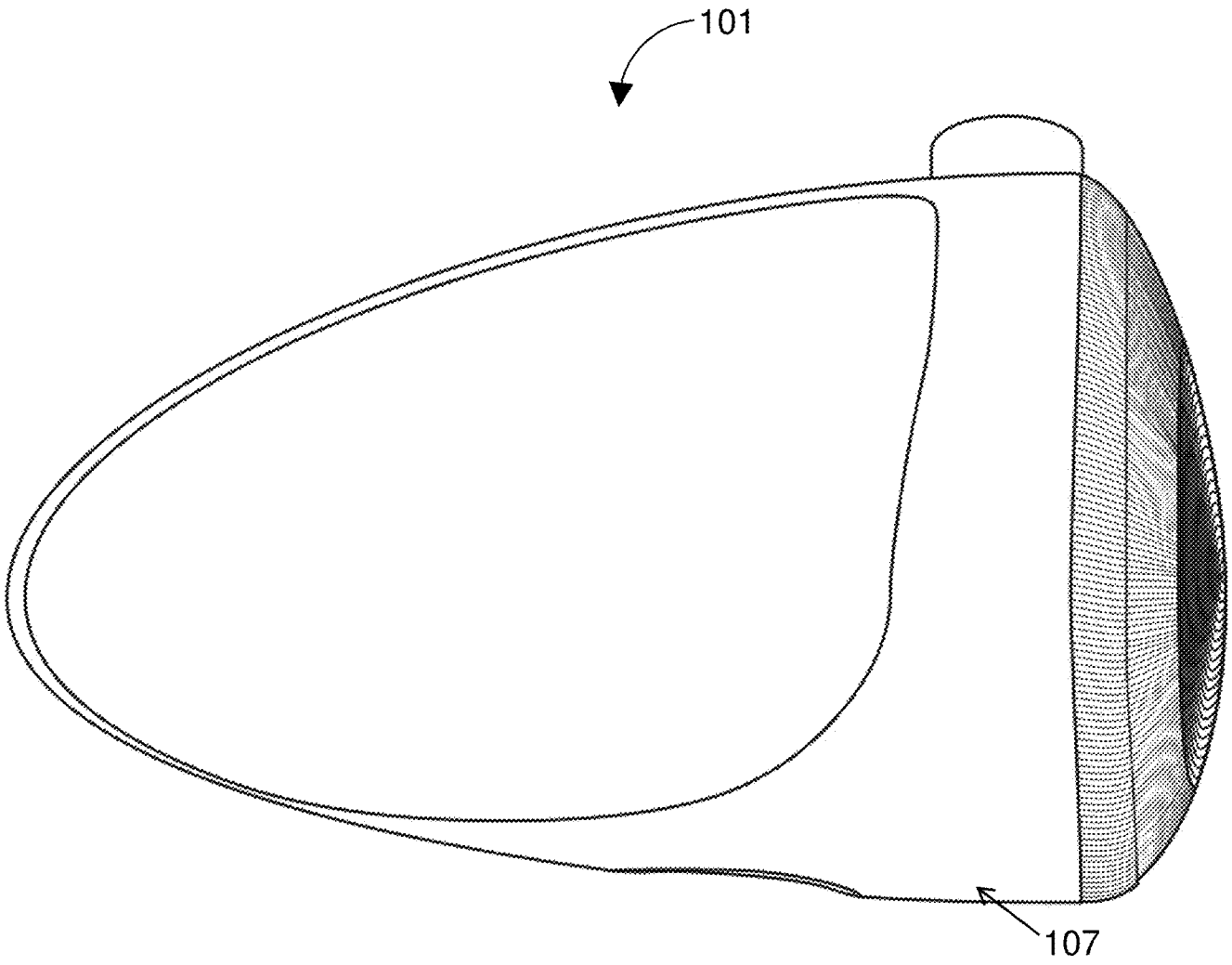
FIG. 5 shows a golf club head from a toe-side view.

FIG. 5 shows a golf club head from a toe-side view.

Figure 6:
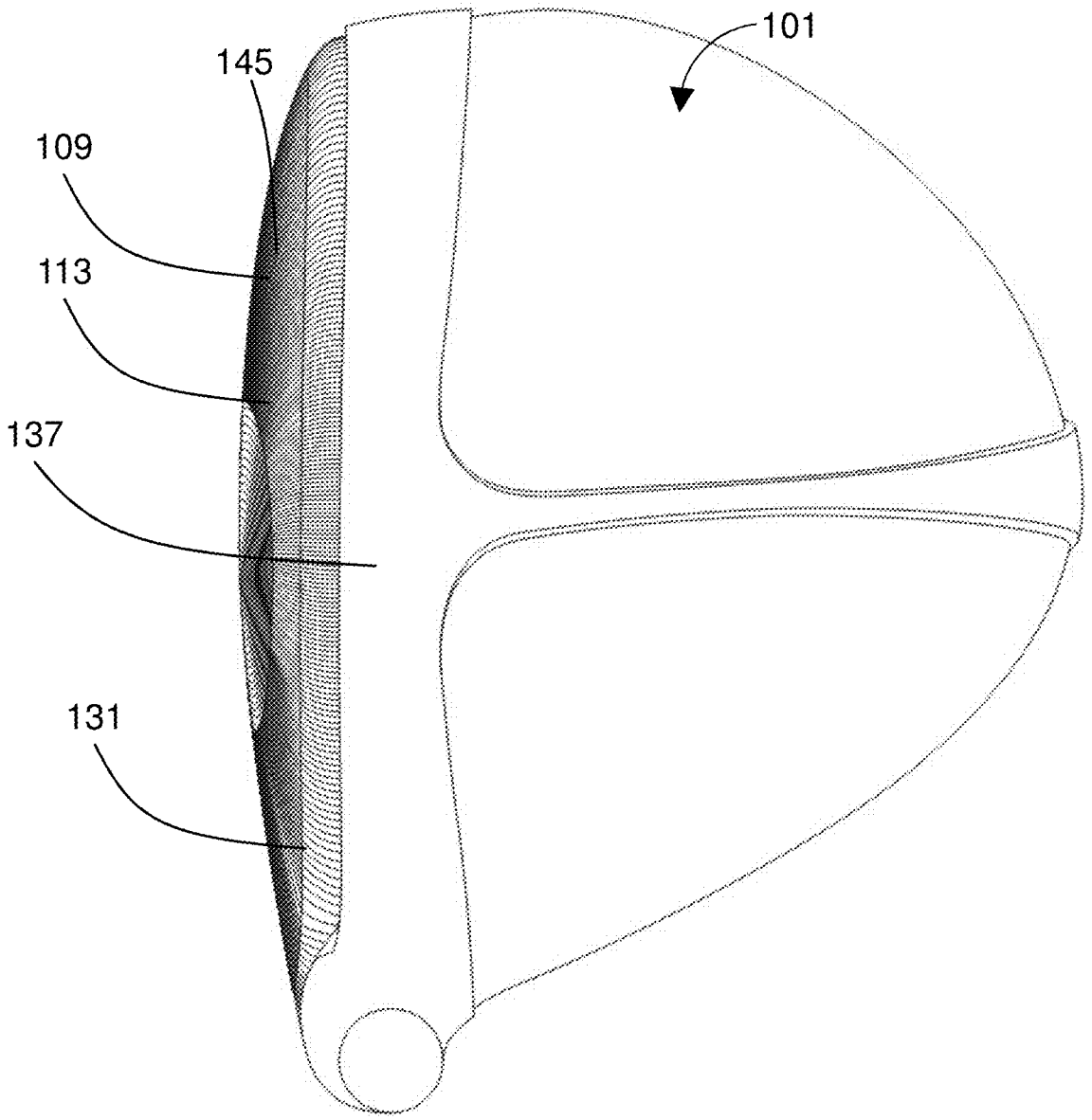
FIG. 6 shows a golf club head from a top view.

FIG. 6 shows a golf club head 101 from a top view and depicts a club face 109 with a machined surface 145 extending over a perimeter 131 of a ball striking surface 113 and onto a portion of the face 109 adjacent to the crown 137. In some embodiments the machined surface 145 extends onto the crown 137.

Figure 7:
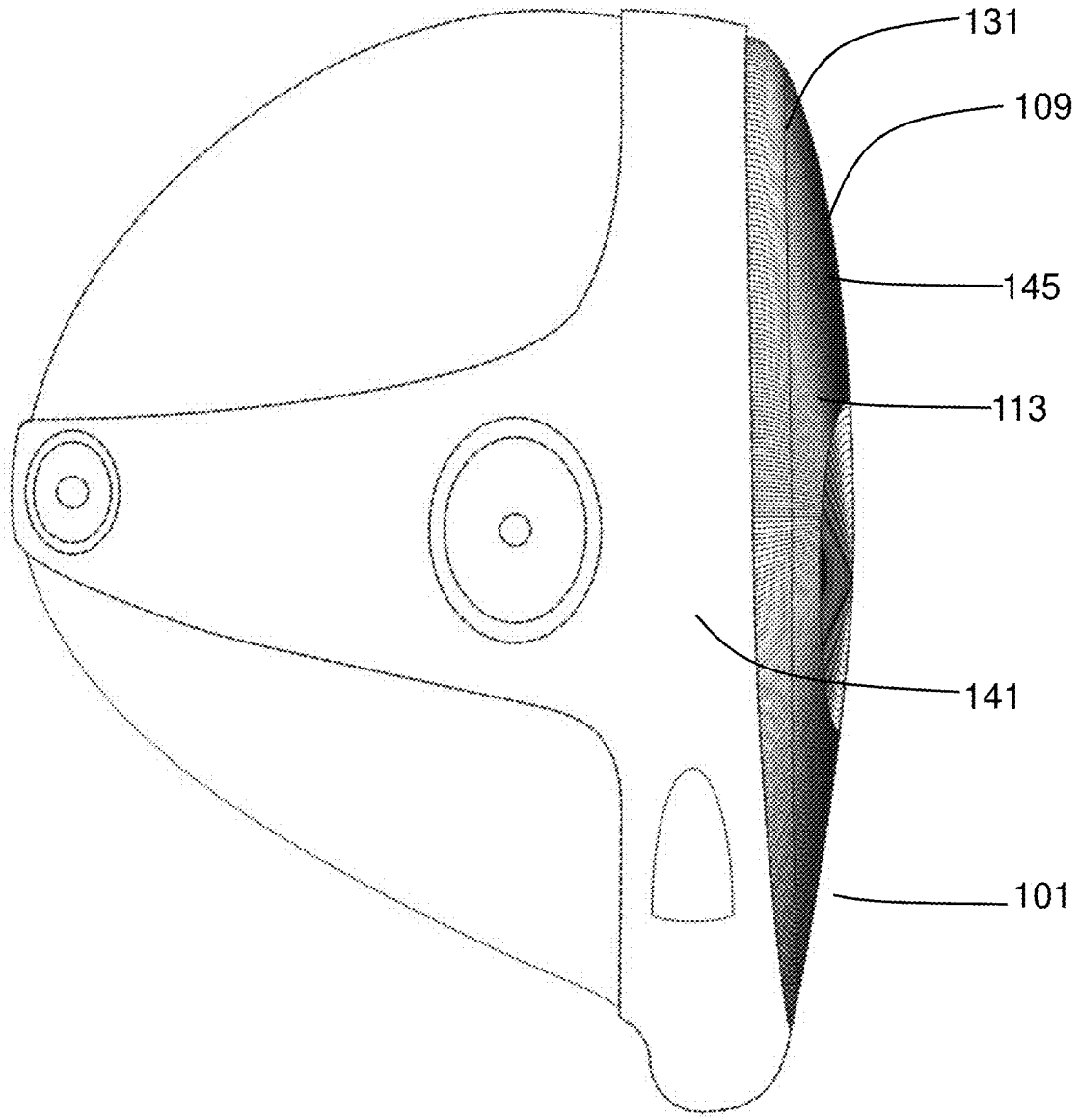
FIG. 7 shows a golf club head from a bottom view.

FIG. 7 shows a golf club head 101 from a bottom view. The club head 101 includes a club face 109 with a machined surface 145 extending over a perimeter 131 of a ball striking surface 113 and onto a portion of the face 109 that meets a sole 141 of the club head 101. In some embodiments the machined surface 145 further extends onto the sole 141. Expanding the machined surface onto the sole 141 can provide improved turf interaction. For example, the machined surface 145 may include grooves, or channels, that reduce the amount of surface area that contacts the ground when the club head 101 hits the turf. In other instances, the machined surface 145 can provide a ramped surface on the sole 141 to enhance turf interaction.

In some aspects, the invention provides a method of making a golf club head. The method includes using a machine, such as a milling machine, to mill a surface onto the club head.

Figure 8:
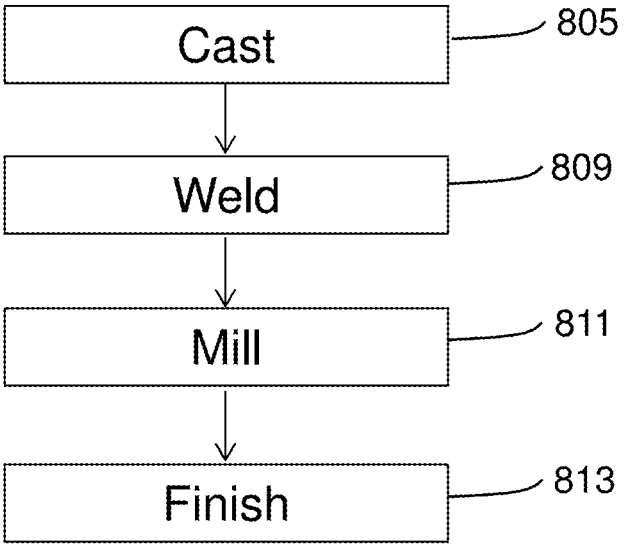
FIG. 8 illustrates steps of a method for making a golf club head according to aspects of the invention.

FIG. 8 illustrates steps of a method for making a golf club head according to aspects of the invention. The club head 101 including the club face 109 can be made from a single piece of material (i.e., the club face 109 and club head 101 are integrally formed with one another to provide a unitary club head) or the club face 109 can be formed from a separate piece of material that can be attached to a club head body 105. In the latter instance, as will be described in greater detail herein, the club face 109 is generally milled after it has been attached to a club head body 105.

In some embodiments, the club head body 105 may generally be defined by a crown 137 and a sole 141 extending from a front portion 103 to meet at a rear portion of the body 105. The club body can be made from a metal or a non-metal, or a combination thereof. In some embodiments, the club head body is cast 805 according to methods well known in the art.

The face 109 is then attached to the club head body 105. In particular, the club face 109 is welded 809 onto the front portion 103 of the club head body 105. Although, one skilled in the art should recognize that any suitable method can be used to attach the face 109 to the body 105, for example, welding, swaging, a tongue-and-groove attachment, a dovetail attachment, mechanical fasteners such as screws, adhesives, press-fit, bendable feet, or any other suitable attachment method. After welding 809 the face 109 onto the front portion 103 of the club head body 105, the face 109 may then undergo milling 811.

The face 109 may be made from a material suitable for milling 811 and subsequent use in striking balls, such as, titanium, steel, aluminum, carbon fiber, or scandium. The entire face 109 can be made from a single piece of material. Preferably, the face 109 is convex and suitable for the head of a hollow type club, such as a driver or fairway wood. A milling machine is used to mill 811 the club face 109. The milling machine can be a computer numerical control (CNC) milling machine. CNC milling can construct a milled face having a precise arrangement of shapes and dimensions. In particular, the milling machine is programmed to cut a milled surface that extends over an edge of a ball striking face 113 and into a portion of the face 109 that meets a crown 137, a sole 141, a toe 147, or a heel 151. The milling machine can also be programmed to cut a pattern into the face 109, wherein the pattern provides improved club head 101 aerodynamics. In addition, guidelines may be provided to mill a cut surface that obtains optimized surface roughness on the club face for improved ball control.

After milling 811 the face 109 (including portions of the crown, sole, toe, and/or heel at the perimeter of the face 109), the club head may be finished 813. Finishing 813 the club head 101 can include any one of the steps of polishing, adding decals, fixing weights to a hollow interior of the club head 101, packaging the club head 101, attaching the club head 101 to a shaft.

In other aspects, the method may generally include the steps of providing a golf club head 101 comprising a body 105 and having a crown 137, a sole 141, a toe 147, a heel 151, and a face 109 comprising a ball striking surface 113, and using a milling machine to cut a milled surface 145 into the face 109, such that the milled surface 145 extends over an edge of a perimeter 131 defining the ball striking surface 113 and onto a portion of the face 109 that meets at least one of the crown 137, the sole 141, the toe 147, or the heel 151.

The machined surface 145 includes a pattern. The pattern may provide aerodynamic features and a hitting surface with improved accuracy. The pattern may include a plurality of grooves 155 milled into the surface of the face 109. The plurality of grooves 155 may extend from a central portion 157 of the club face 109, over an edge that defines a perimeter 131 of a ball striking surface 113 and into at least a portion of the face 109 joining a crown 137, a sole 141, a toe 147 or a heel 151.

The spacing between any pair of adjacent grooves 155 can increase at increasing radial distances from the central portion 157 of the ball striking surface 113 and also extend over a perimeter 131 of the ball striking surface 113. The central circular portion 157 can comprise a grooved spiral 163, wherein the spiral 163 comprises a plurality of parallel curves and a separation distance between any two adjacent parallel curves is approximately equal. The milled pattern may be designed to disrupt laminar air flow away from the ball striking surface and improve aerodynamics of the club head.

Figure 9:
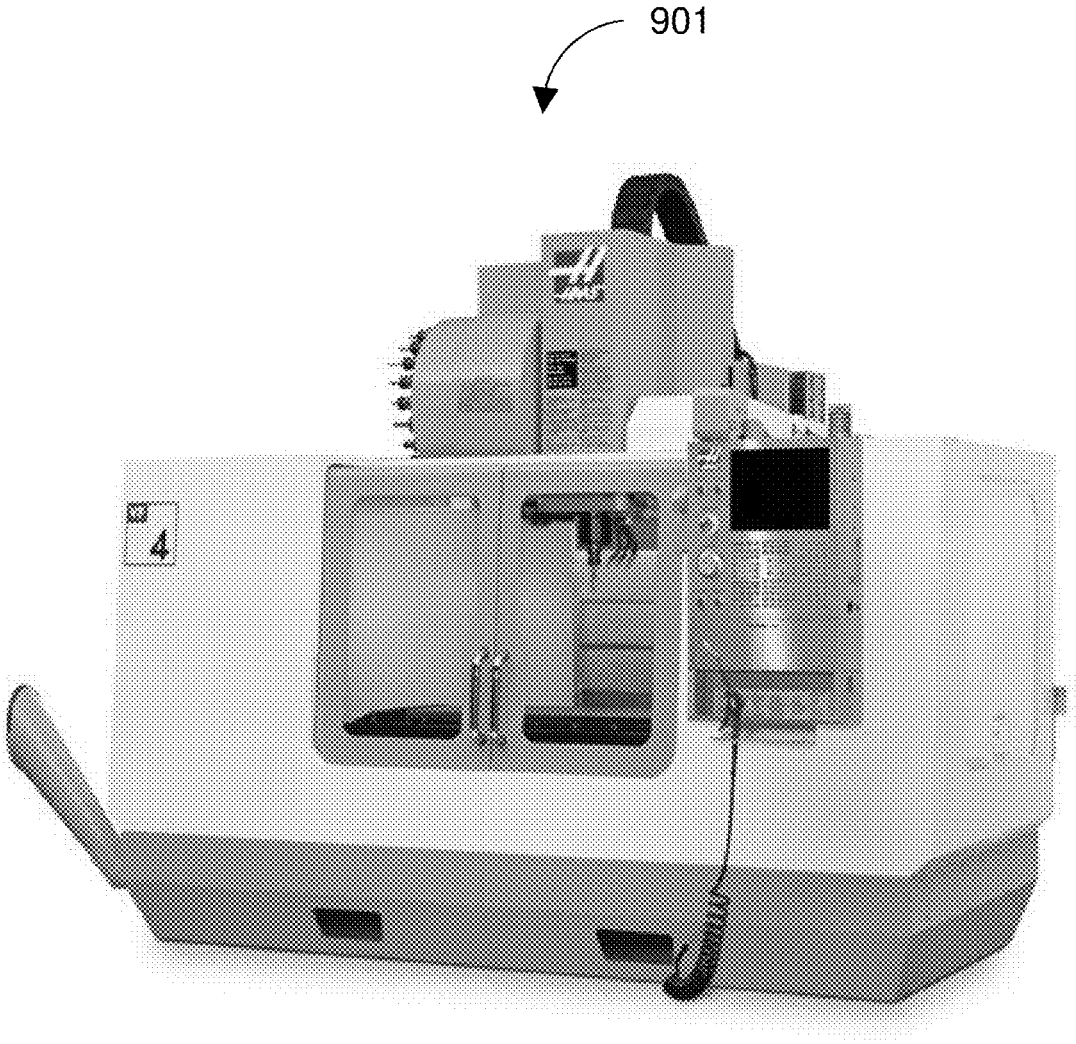
FIG. 9 shows a machining instrument.

FIG. 9 shows an exemplary machining instrument 901 useful for accomplishing the methods of the disclosure. The machining instrument 901 may be, as an example, a Vertical Machining Center ("VMC") that is capable of automation by programmed commands encoded on a storage medium, such as a computer numeric control ("CNC"). The machining instrument 901 can be provided as a CNC VMC for use in methods of the invention. While one of skill in the art will understand that any of a number of suitable milling machines may be used for CNC VMC, an exemplary such machine is the Vertical Machining Center sold as Model VF-2 by Haas Automation, Inc. (Oxnard, Calif.).

Numerical control (NC) is the automated control of machine tools by means of a computer. Such that, machine tools are controlled by programmed commands encoded on a storage medium, as opposed to controlled manually via hand wheels or levers, or mechanically automated via cams alone. Most common NC today is computer numerical control (CNC).

In modern CNC systems, end-to-end component design may be automated using computer-aided design (CAD) and computer-aided manufacturing (CAM) programs. The programs produce a computer file that can be interpreted to extract commands needed for the operation of a particular machine via a postprocessor, which is then loaded into the CNC machines for production. Since any particular component might require the use of a number of different tools—such as drills, saws, etc.—modern machines often combine multiple tools into a single "cell".

Mills typically use a table that moves on an X and Y axes, and a tool spindle that can move on a Z axis for depth. The position of the tool is driven by motors through a series of step-down gears in order to provide highly accurate movements, or in modern designs, direct-drive stepper motor or servo motors.

An advanced CNC milling-machine, known as a multi-axis machine, may be used for methods described herein. A multi-axis machine may include additional (e.g., two) axes in addition to the three normal axes (XYZ). Some machines may have a C or Q axis, allowing the horizontally mounted workpiece to be rotated, essentially allowing asymmetric and eccentric turning. A fifth axis (B axis) controls the tilt of the tool itself. When all of these axes may be used in conjunction with each other, extremely complicated geometries, even organic geometries such as a human head can be made with relative ease with these machines. Typically, a 5-axis milling machines will be programmed with computer-aided manufacturing (CAM) tools.

Milling devices described herein may be used with known, standardized, or customized tooling systems. In general, the accessories and cutting tools used on milling machines are referred to in aggregate by the mass noun "tooling". There is a high degree of standardization of the tooling used with CNC milling machines, and a lesser degree with manual milling machines.

Many CNC milling machines use SK (or ISO), CAT, BT or HSK tooling. SK tooling is common in Europe, while CAT tooling, sometimes called V-Flange Tooling, is common in the United States. CAT tooling was invented by Caterpillar Inc. of Peoria, Ill., in order to standardize the tooling used on their machinery. CAT tooling comes in a range of sizes designated as CAT-30, CAT-40, CAT-50, etc. The number refers to the Association for Manufacturing Technology (formerly the National Machine Tool Builders Association (NMTB)) Taper size of the tool.

A milling device may also use BT Tooling. Like CAT Tooling, BT Tooling comes in a range of sizes and uses the same NMTB body taper. However, BT tooling is symmetrical about the spindle axis, which CAT tooling is not. This gives BT tooling greater stability and balance at high speeds.

One other subtle difference between these two tool-holders is the thread used to hold the pull stud. CAT Tooling uses Imperial thread and BT Tooling uses Metric thread.

In practice, the workpiece material is loaded into the milling machine. The workpiece is a material selected for inclusion in the final club head. For example, in some instances the workpiece is the face 109, which is subsequently attached to the club head body 105. Any suitable material may be used to make a golf club face including metals, polymers, composites, and other materials, and a combination thereof. Examples include steel, aluminum, titanium, alloys, plastics, carbon fiber, or any other material. In certain embodiments, a golf club face is made from stainless steel.

Using a CNC VMC, the computer program is selected and the machine is set to operate. The work piece is loaded into the mill, which is programmed according to the manufacturer's instructions. The machine spindle spins the milling cutter while the table advances the workpiece material through the cutting area.

As material passes through the cutting area of a milling machine, the blades of the cutter take swarfs of material at regular intervals. The cutting operation produces revolution marks and cuts into the material creating the roughness on the surface. The mill then operates automatically, according to the programming. The invention provides guidelines for programming the mill to cut a milled surface that extends over an edge of the radius around a leading edge, toe, and topline. The invention also provides guidelines for programming the mill to cut a milled surface onto the face of the club that extends beyond an edge of a ball striking surface and onto a perimeter of the face where the face meets at least one of a crown, the sole, the toe, or the heel. In addition, guidelines may be provided to mill a cut surface that obtains optimized surface roughness on a golf club face.

Aspects of the invention provide a club head having a club face with a milled surface that expands over an edge of a radius of a ball striking surface and into a portion of the face adjacent to at least one of a crown, a sole, a toe, or a heel. In preferred embodiments, the milled surface expands across an entire perimeter of the ball striking surface to join each of the crown, the sole, the toe, and the heel. A club head according to this design benefits from a smooth border around an entire periphery of the ball striking surface which facilitates the movement of air around the club head body as the club head is moving through the air.

In other aspects, the invention provides a club head with a machined surface that traverses an edge of a ball striking surface and into a portion of the face adjacent to at least one, but not all, of a crown, a sole, a toe, or a heel. For example, in some embodiments the machined surface may extend over the edge of the ball striking surface join the crown but terminate at the perimeter of the ball striking surface where the face is adjacent to the sole, the toe, and the heel. When a club head according to this embodiment is swung, the air flow over the top of the club head may be at a steeper angle and move faster than the flow of the air under the bottom of the club head. This can provide an upward force that lifts the club head as the club head moves through the air. In addition, the machined area can provide a textured surface that disrupts laminar air flow. Disrupting laminar air flow reduces drag to increase club head speed.

In other aspects, the disclosure provides a club head with a machined surface that extends over a bottom edge of a radius of the ball striking surface to meet the sole. The machined surface according to this embodiment can provide a surface for improved turf interaction. Turf interaction generally refers to the frictional interaction between the golf club and the ground. In most instances, it is desirable to minimize turf interaction. Perimeter face machining can be used to reduce turf interaction by, for example, cutting a plurality of grooves into a lower perimeter border such that when the club face strikes the turf, less surface are of the club face makes contact.

The pattern machined onto the club face can encompass a substantial surface area of the club face. For example, the pattern may cover greater than 90% of the surface area of the club face. As discussed, providing a club head with a machined pattern may improve both aerodynamic and ball control. In addition, the pattern can impact harmonics from the ball striking the club face. In some instances, the pattern may comprise a smaller portion of the club face, with areas void of the pattern. Areas lacking the pattern can offer different harmonics and feedback when striking a ball. In particular, striking a golf ball with an area of the club face lacking indentations can result in more energy transfer from the golf club face to the golf ball and produce a different sound that might indicate to the golfer a mishit. Thus, the pattern machined onto the club face may be strategically missing from some areas of the face to provide a golfer feedback as to which area of the club face the golfer is striking the ball.

In some instances, the plurality of grooves 155 has a depth that is uniform and consistent across the club head 101. Alternatively, because the depth of the grooves can influence ball spin, it might be desirable for different portions of the face 109 to include grooves with different depths in order to impart different spin signatures on the ball depending on which area of the surface 113 strikes the ball. In addition, groove depth can impact the harmonics of the ball striking surface.

The plurality of grooves 155 may have a depth that varies along the length of the groove. For example, a groove may include a depth at one end that is different than the depth at the depth at the other end. Or, for example, the depth of the grooves can be deeper on the ball striking surface 113 than on the perimeter of the face. The spacing between any pair of adjacent grooves preferably increases at increasing radial distances from the central portion 157 of the face 109.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A golf club head comprising:

a body including a crown, a sole, a toe, a heel, and a face with a ball striking surface; and a machined surface on the face that traverses a perimeter defining the ball striking surface and into a portion of the face adjacent to at least one of the crown, the sole, the toe, or the heel, wherein the machined surface comprises aerodynamic features defined by a pattern provided on the machined surface that includes a plurality of grooves expanding outwardly from a central portion of the ball striking surface, wherein the central portion includes a single spiral groove that comprises a plurality of parallel curves and a separation distance between two adjacent parallel curves is approximately equal, wherein the single spiral groove has only two ends, and wherein the only two ends of the single spiral groove are at an outer boundary of the central portion away from a center of the central portion.

2. The golf club head of claim 1, wherein a spacing between adjacent pairs of the plurality of grooves increases at increasing radial distances from the central portion of the ball striking surface.

3. The golf club head of claim 1, wherein the machined surface traverses the perimeter of the ball striking surface and onto the portion of the face that is adjacent to each of the crown, the sole, the toe, and the heel.

4. The golf club head of claim 1, wherein the machined surface disrupts laminar air flow away from the ball striking surface and improves aerodynamics.

5. The golf club head of claim 1, wherein the face has a roll radius.

6. The golf club head of claim 1, wherein the face has a bulge radius.

7. The golf club head of claim 1, wherein the body is hollow.

8. The golf club head of claim 1, wherein the club head is a driver style club head.

9. A golf club head comprising:

a body including a crown, a sole, a toe, a heel, and a face with a ball striking surface; and a machined surface on the face that traverses a perimeter defining the ball striking surface and into a portion of the face adjacent to at least one of the crown, the sole, the toe, or the heel, wherein a pattern is provided on the machined surface that includes a single spiral groove expanding outwardly in a central portion of the ball striking surface, wherein the single spiral groove comprises a plurality of parallel curves and a separation distance between two adjacent parallel curves is approximately equal, wherein the single spiral groove has only two ends, and wherein the only two ends of the single spiral groove are at an outer boundary of the central portion away from a center of the central portion.

10. The golf club head of claim 9, wherein the machine surface includes a plurality of grooves expanding outwardly from the central portion of the ball striking surface.

11. The golf club head of claim 10, wherein a spacing between adjacent pairs of the plurality of grooves increases at increasing radial distances from the central portion of the ball striking surface.

12. The golf club head of claim 9, wherein the machined surface traverses the perimeter of the ball striking surface and onto the portion of the face that is adjacent to each of the crown, the sole, the toe, and the heel.

13. The golf club head of claim 9, wherein the face includes at least one of a roll radius and a bulge radius.

14. The golf club head of claim 9, wherein the club head is a driver style club head.

15. A golf club head comprising:

a body including a sole, a toe, a heel, and a face with a ball striking surface; and a machined surface on the face that traverses a perimeter defining the ball striking surface, wherein a pattern is provided on the ball striking surface that includes a spiral groove expanding outwardly in a central portion of the ball striking surface, wherein the spiral groove expands outwardly to an outer boundary that is arranged inwardly from the perimeter, wherein the spiral groove has only two ends, and wherein the only two ends of the spiral groove are at the outer boundary of the central portion away from a center of the central portion.

16. The golf club head of claim 15, wherein the machine surface includes a plurality of grooves expanding outwardly from the central portion of the ball striking surface.

17. The golf club head of claim 16, wherein a spacing between adjacent pairs of the plurality of grooves increases at increasing radial distances from the central portion of the ball striking surface.

18. The golf club head of claim 15, a separation distance between two adjacent parallel curves of the spiral groove is approximately equal.

19. The golf club head of claim 15, wherein the face includes at least one of a roll radius and a bulge radius.

20. The golf club head of claim 15, wherein the club head is a driver style club head.

* * * * *